US005827130A

United States Patent [19]

Jimenez et al.

[11] Patent Number: 5,827,130

[45] **Date of Patent: *Oct. 27, 1998**

[54] TAIL HEAVY GOLF PUTTER

[76] Inventors: Rafael F. Jimenez, 312 Spring St., Richland, Wash. 99352; Gregory L. Jimenez, 7706 Swanson Dr., NW., Gig Harbor, Wash. 98335

[ * ] Notice: The term of this patent shall not extend beyond the expiration date of Pat. No. 5,494,288.

[21] Appl. No.: 556,804

[22] Filed: Nov. 2, 1995

Related U.S. Application Data

[63] Continuation-in-part of Ser. No. 447,051, Dec. 7, 1989, abandoned.

[51] Int. Cl.[6] ..... A63B 53/04

[52] U.S. Cl. ..... 473/313; 473/314; 473/341

[58] Field of Search ..... 473/313, 314, 473/324, 334, 335, 340, 341, 349, 251, 256, 316, 325; D21/217, 218

[56] References Cited

U.S. PATENT DOCUMENTS

| | | | |
|---|---|---|---|
| 1,703,199 | 2/1929 | McClure | 473/313 |
| 1,901,562 | 3/1933 | Main | 473/330 |
| 2,023,885 | 12/1935 | Hinckley | 473/330 |
| 4,063,733 | 12/1977 | Benedict | 473/313 |
| 4,173,343 | 11/1979 | Richilano | 473/251 |

*Primary Examiner*—Sebastiano Passaniti
*Attorney, Agent, or Firm*—Floyd E. Ivey

[57] ABSTRACT

A golf putter is disclosed having a face that tends to stay square to the swing path as a result of an increased static moment about the putter shaft. The increased static moment is a result of the tail section of the putter head having a mass greater than the toe section.

3 Claims, 15 Drawing Sheets

TAIL HEAVY GOLF PUTTER

CONTINUATION-IN-PART

This is a Continuation-in-Part Application relying on and claiming the priority of the application entitled "TAIL HEAVY PUTTER", application Ser. No. 07/447,051 with Filing Date Dec. 7, 1989 abandoned.

A. FIELD OF THE INVENTION

The present invention relates generally to golf putters and relates in particular to center-shafted golf putters where the putter shaft axis intersects the putter head at approximately the longitudinal midpoint of the blade having a face that tends to stay square to the swing path as a result of an increased static moment about the putter shaft.

B. SUMMARY OF THE INVENTION

When putting a golf ball with a conventional putter (including even a putter which is statically "face-balanced," that is, a putter which when balanced about the horizontal shaft, the putter face remains horizontal), the putter face will open upon positive acceleration (dv/dt>0) and close upon deceleration (dv/dt<0). We have come up with two versions of our tail heavy putter: the "0-0 EDGE" which is slightly tail heavy and is dynamically balanced while being swung and is force balanced when striking a golf ball; and the "Heel-Heavy" which tends to open when decelerating and when a golf ball is struck. The "Heel-Heavy" is for those players who tend to close the putter face when swinging or striking the ball.

Additionally, the sole has a surface described by a two-coordinate relationship (i.e., it is not a planar surface) which virtually eliminates the bad effects resulting from catching the putter tail or toe on the putting surface or from scuffing the sole on the green.

The putter is vertically counter-balanced by inserting weights onto or into the top end of the shaft-making it easier to swing the putter. Weighting the top of the shaft is the most efficient method of counterweighting as it requires the least amount of weight. This technique is applicable to both golf putters and golf clubs.

The putter is constructed with the hosel attached to the backside of the putter blade—so that even with the shaft and hosel constructed in-line, and the "sweet spot" also in line, the golfer is still able to easily see the back of the golf ball when lining up the putt.

The transmittal of force from the ball is direct (i.e., no "moment" members are involved) because the shaft, hosel, and ball center are all in line. Thus, it is relatively easy to hit the ball the correct distance.

C. BACKGROUND AND ADDITIONAL SUMMARY OF THE INVENTION

Three putter styles are referred to herein including a cavity back putter, a symmetric blade putter and a mallet putter. The applications on which this Continuation-in-Part Application relies focused on the cavity back style putter.

The cavity back putter, shown in FIGS. 6 through 14 and as disclosed in the parent application, features a cavity back, as disclosed in the parent application, so that more weight can be provided at the heel and toe to increase the rotational moment of inertia. The tail has a greater static moment about the shaft than the toe thus providing rotational stability when the ball is struck. The club design depends upon the putter shaft and the ball-point of contact being in-line.

The symmetric blade putter, disclosed in this Continuation-in-Part application, features a putter head which is symmetric about its longitudinal axis extending from toe to heel so that it can be used by right or left handed golfers. The mechanical design is based upon the same principles as the cavity back putter and as disclosed in the parent application. The symmetric blade putter is shown in FIGS. 16 through 19.

The mallet head putter, disclosed in this Continuation-in-Part application, features a putter head design in which the weight is distributed both perpendicularly from the swing path(i.e. the same as the cavity back and symmetric blade putters) and also in-line with the swing path. The mallet putter design is again based upon the same principles as the cavity back and the symmetric putters. The mallet putter is shown in FIGS. 20 through 23.

FIGS. 1 through 5 and FIG. 24 apply to all three styles of putters. FIGS. 16 through 19 relate to the symmetric blade putter and FIGS. 20 through 23 relate in particular to the mallet head putter.

The focus of the present invention is explained in part by the concept of Percent Tail-Heavy. This term is defined with reference to FIGS. 6, 16, and 20 as the golf putter tail static moment divided by the golf putter toe static moment minus 1 times 100. The discussion in this paragraph is a summary of the test disclosed within FIG. 6 with the parent application and refers in common to the cavity back, the symmetric blade and the mallet head putters. Let the toe force-moment about the putter shaft(effective force×moment arm)=X; then an additional force moment >0.001X and <0.150X will be required to statically balance the "Tail-Heavy" putter(i.e. keep the putter face horizontal). In this discussion, 0.0001X=0.1% and 0.150X=15.0%. While FIG. 6 depicts a cavity back putter the notations thereon apply equally to the symmetric blade and mallet head putter. By using this definition, the basis for the tail-heaviness requirements of the range of tail-heaviness as disclosed in this invention is illustrated by reference to FIGS. 1, 5, 6, 8, 9, 16, 17, 20, 21, and 24. It is to be noted that FIG. 24 is a variation of FIG. 1 with both Figures demonstrating the same principles. While FIG. 5 depicts a cavity back putter the annotations thereon including reference to the handle apply equally to the symmetric blade and mallet head putter.

Considering now the reason for the upper limit on tail-heaviness, if tail heaviness over 15% is used, the putter head tends to rotate clockwise upon striking the ball and the ball then tends to go to the right of the intended path assuming the golfer is right handed. Thus, the range of tail-heaviness of 0.1% to 15% as disclosed and claimed is critical since tail-heaviness below the minimum would not effectively counteract the tendency to close the putter face based upon either physics or biomechanics as it would not equalize the heel dynamic moment and the toe dynamic moment about the shaft axis. Tail-heaviness greater than 15% would cause the putter face to tend to rotate clockwise when striking the ball thus opening the putter face and causing the ball to go to the right of its intended path.

Reference to FIG. 5 demonstrates a putter with an instantaneous swing axis 9 identified. When a putter is swung the path or arc described by the putter shaft and putter head is the swing plane. The instantaneous swing axis 9 is perpendicular to both the longitudinal shaft axis 24 and to the swing plane.

D. BRIEF DESCRIPTION OF THE DRAWINGS OF THE "TAIL HEAVY GOLF PUTTER"

The foregoing and other features and advantages of the present invention will become more readily appreciated as the same become better understood by reference to the following detailed description of the preferred embodiment of the invention when taken in conjunction with the accompanying drawings, wherein:

FIG. 1 illustrates the translational and rotational movement of the golf club just before the ball is struck. The instantaneous center of club rotation is also shown.

FIG. 2, showing the top of a golf club shaft without grip, illustrates how vertical counter-balancing of a golf club con most efficiently be done by placing a counter weight at the top of and just inside the shaft FIG. 3 illustrates how the putter "marker" position (i.e., the so-called "sweet spot" location) is determined. First, the "expected horizontal plane of contact "between the ball and putter face is determined. Then the "Marker" position is placed at the intersection of this horizontal plane and a plane running through the putter shaft as shown on the drawing. This figure illustrates a vertical plane passing through the putter-ball contact point, i.e., the marker position, relative to a horizontal plane on which the putter-ball contact is expected to be made. Illustrated is the putter face showing the expected putter-ball contact point, i.e., the intersection of the horizontal plane and the putter shaft plane(the putter shaft plane lies between the vertical and horizontal plane and intersects the expected putter-ball contact point.

FIG. 4 shows a cross-section of the putter head, showing the putter face and the extension of the putter hotel, and illustrates the shape of the putter sole. The sole shape at the front and back is either a conic surface or a portion of the surface of a hyperboloid of revolution. The central portion is semi-flat but the entire sole is rounded from tail to toe with a maximum radius of 10". Thus no part of the sole surface is a planar surface but instead, the surface is a function of two coordinates (the front to back coordinate and the heel-to-toe coordinate).

FIG. 5 illustrates that the toe is approximately 1" further from the putter swing axis than is the tail. This figure additionally shows $Y_h$=distance from swing axis to effective tail mass and $Y_t$=$Y_h$+1"=distance from swing axis to effective toe mass. Thus, when the putter is swung (i.e., rotated about the swing axis) the toe has a greater velocity than the tail. Therefore, if the putter face is to say square, without any additional external rotating force, the tail static moment about the shaft must be greater than the toe static moment (hence the designation "tail heavy"). This figure illustrates the putter toe, putter heel(tail) and shows the instantaneous putter swing axis.

FIG. 6 defines the main putter design feature for which a patent is being applied for. The patent is to cover a putter which must have an added force moment (AFM) on the toe side in order to statically balance the putter head about the shaft. This illustration demonstrates the added force movement (AFM) required to keep the putter head horizontal when balanced about the shaft. This figure shows the putter face horizontal demonstrating the AFM vertical force indicating the 0.150x>AFM>0.0001x tail heaviness. The moment arm is shown between the putter hotel and shaft extension and the effective force near the toe. This safely keeps this putter out of the design range of t hose which have heretofore been manufactured. Very few putters are statically balanced and none (except when miscast) are designed to be tail heavy except the "AS BACKWARDS" which has the shaft coming into the toe and thus is extremely tail heavy. The vast majority (Ping, Bullseye, etc.) are quite toe heavy. We are seeking a patent for a putter which is between 0.1% tail heavy and 15% tail heavy with this range forming the definition of percent tail heavy.

FIG. 7 is an isometric sketch of the golf putter head.

FIG. 8 is a plan view of the tail heavy golf putter head. This figure illustrates the putter blade, putter face, toe and tail. Additionally shown is the lineup marker.

E. DETAILED DESCRIPTION OF PATENT

Figure 1:
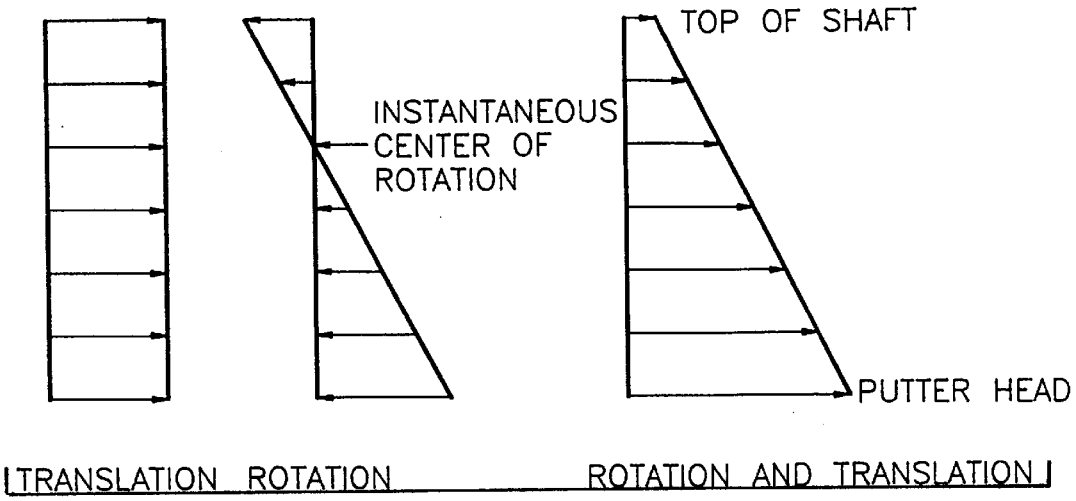

I. The main golf putter improvements we have made (i.e., dynamic swing balance and the elimination of putter face twist when the ball is struck (only strictly true for our "0-0 EDGE" putter) stem from the concept, shown in FIG. 1, that just before the ball is struck the movement of the club can be described by a translational movement and a rotational movement of the putter. Thus the putter must be statically, "tail-heavy" to be in dynamic balance.

Figure 2:
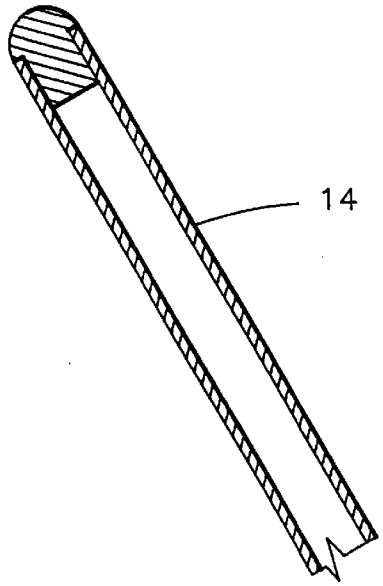

II. Another important improvement is the counter weighting of the putter (or any golf club) by adding weight at the top of the shaft as shown in FIG. 2. A patent on the concept of counter weighting is not sought but rather the:

a. Method of counterweighting as shown in FIG. 2.

b. Degree of counterweighting, that is counterweighting in the extreme, by adding approximately 0.3–1.5 oz. to the top of the shaft to facilitate the rotation of the club as it is swung at the golf ball.

Figure 13:
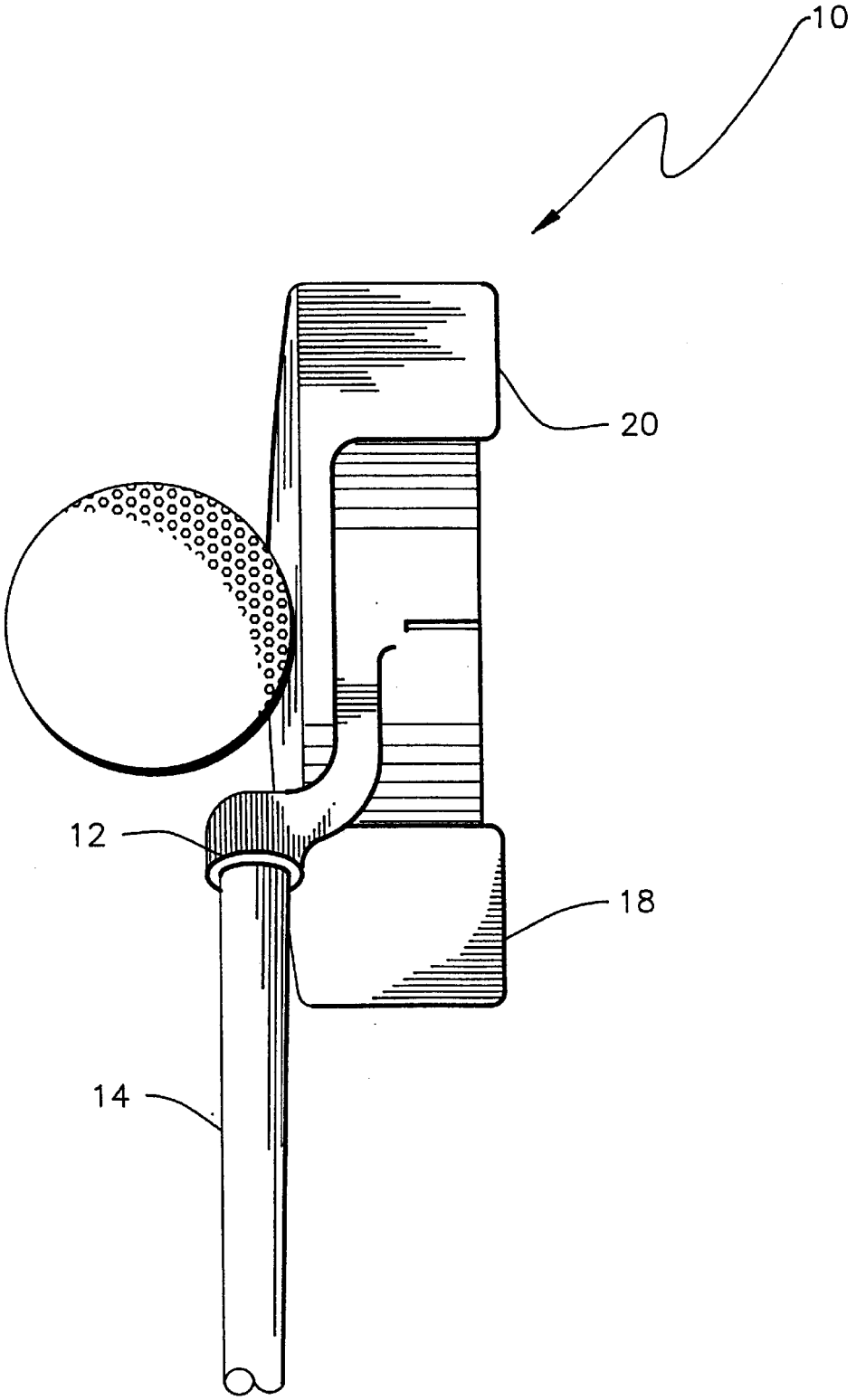
FIG. 13 illustrates how the golfer can easily see the back of the ball while lining up a putt because the hosel is attached to the back of the putter blade.
Figure 14:
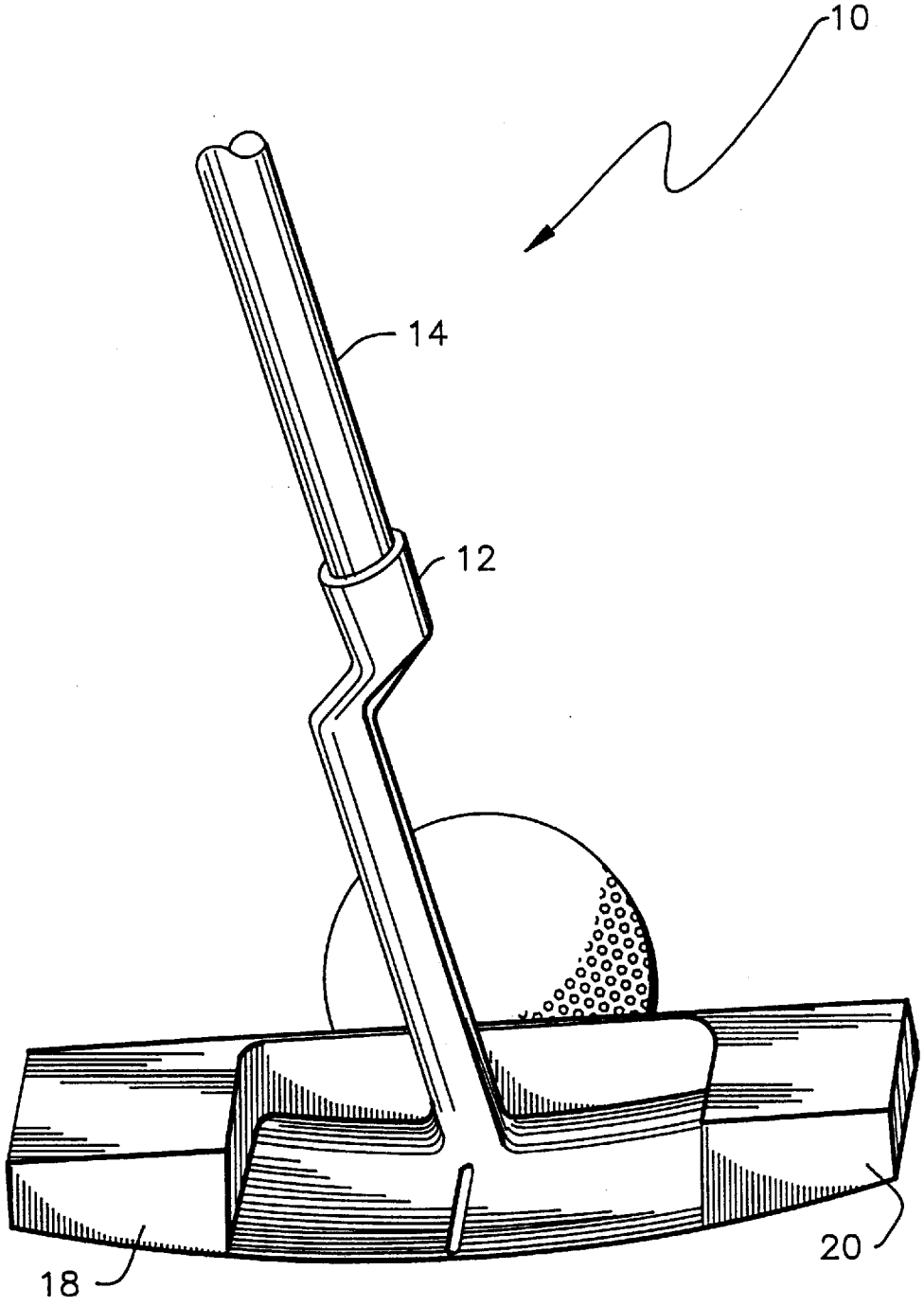
FIG. 14 illustrates how lining up a putt is easier with the tail heavy putter because the marker, ball center and intended ball path are easy to line up.
Figure 15:
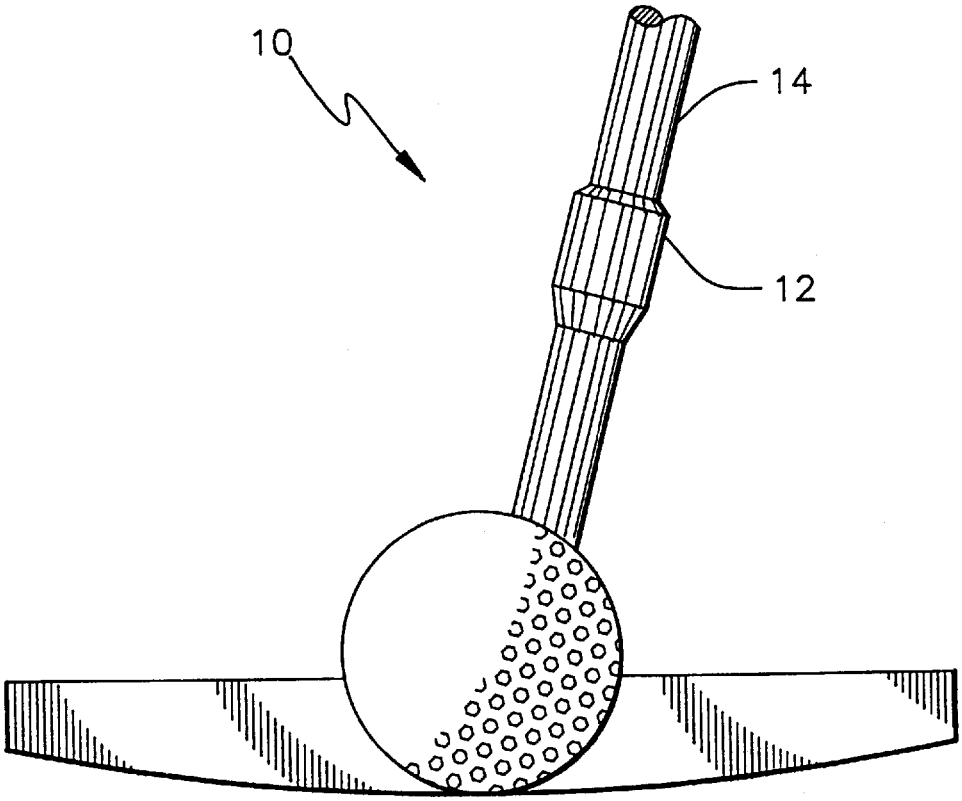
FIG. 15 illustrates how the force transfer from the shaft to the ball contact point is direct because the shaft, hosel and contact point are in line.

III. A third improvement is that the attitude of the putter blade, hosel shaft, and putter marker is such that:

a. The back of the ball can be easily seen when preparing to putt (FIG. 13).

b. Lining up the putt is easier than with other putters because lining up the marker, the ball centerline, and the intended ball path is facilitated (FIG. 14).

c. Force transfer from the shaft to the ball is more direct (i.e., moment carrying members are not used in the plane perpendicular to the ball path) than with other putters because the shaft centerline, the hosel centerline, and the ball contact point are in line (FIG. 15).

IV. Another major improvement is that the bottom surface of the putter head (i.e., the "sole") is conic-shaped (see FIG. 4: cone-shaped sole surface) to decrease the possibility of and the deleterious effects of scuffing the putter sole on the green (note that this bottom surface is not a planar surface but is a true two-dimensional surface defined by the tail-to-toe coordinates and by the coordinates in the direction perpendicular to the tail-toe direction).

The conic-shaped sole decreases the possibility of scuffing the club by:

a. Rounding the putter head in the tail to toe direction (a 10" maximum radius is used).

b. Beveling or rounding the sole in the direction perpendicular to the tail-toe direction to prevent scuffing the frontal portion of the putter head on the forward swing or the back portion of the putter head on the back swing.

These four major improvements are the basis for this patent application. Our "0-0 EDGE" putter is now in production on a small scale (290 putters, including 22 lightweight prototypes, have been produced since April 1989). The prototype was introduced at an industrial trade show in Pasco, Wash., on May 5–6, 1989. The production of full-weight putters began in June 1989 and the putter was shown at the Pacific Northwest Professional Golfer Association exhibit on October 29–30 in Tacoma, Wash. The putter has been extremely well received. Production has not proceeded at a fast pace because both my son and I are employed full time and because, up to this time, we have not sought outside financial assistance in our venture since we have chosen not to dilute our ownership. The proof of the viability of these golf putter improvements is that the putter we are manufacturing has performed extremely well. Approximately one-half of the golfers who have bought our new putter formerly used the "PING" putter which has had the reputation of being one of the best putters available. (The "PING" putter was used to win the four most prestigious golf tournaments in 1988: The Masters, the PGA, and the American and British Opens.)

We do not pretend that our putter is as prestigious or well known as other putters, but we do contend that our putter is better than any other putter for most golfers.

V. Detailed Description of How the Four Major Improvements Are Obtained

The following design improvements and concepts are used in our "0-0" EDGE" putter and explained in detail below:

a. Transactional and Rotational Movement of the Golf Putter (or golf club)

Just before a golf putter (or golf club) strikes the ball, it is undergoing both translational and rotational motion in the plane parallel to the direction in which the ball will travel. Though the top of the club is hinged at the left wrist (for a right-handed player), in actuality the instantaneous center of rotation is between the top of the putter shaft and the putter head. Superimposed upon this rotation is the translational motion of the entire putter in the direction of the ball travel. This is illustrated in the velocity diagrams shown in FIG. 1.

b. Dynamic Balancing About the Shaft

Incorporating into the design of the "0-0" putter is dynamic balancing about the shaft as the putter is swung backward and forward. Dynamic balancing keeps acceleration forces from twisting the putter head about the shaft as it is swung back and forth. The concept of making the putter tail heavy arises from theories of dynamics and mechanisms that state that mass further from the swing center (FIG. 5) has greater velocity and acceleration and therefore exerts a greater acceleration force. Thus the putter is slightly tail heavy when statically balanced as the toe velocity is greater than that of the tail because it is further from the instantaneous swing center. The concept of zero dynamic twist represents the first "0" in "0-0 EDGE." This feature stems from the rotational concept shown in FIG. 1.

c. Marking the Golf Putter "Sweet Spot" so that No Twist is Imparted to the Putter When the Ball is Struck The "0-0 EDGE" putter has its "sweet spot" marked so that if the ball is struck correctly, there is no twist imparted to the putter blade provided that:

The marker and ball are in line at the moment of contact.

Figure 3:
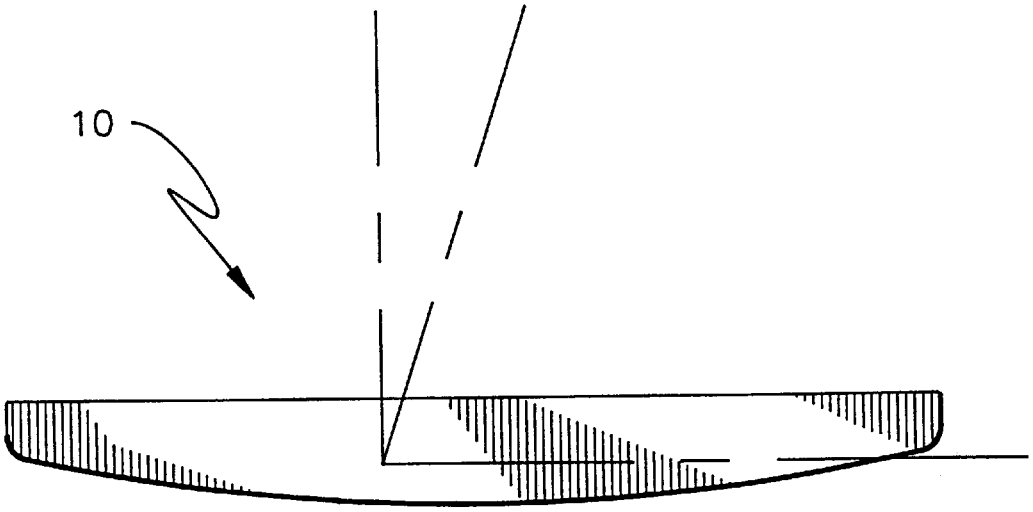

The ball-putter face contact point is in line with the shaft center line (note: there is no single vertical plane parallel to the ball path that intersects the shaft centerline extension but rather an infinite number of vertical planes parallel to the ball path which intersect the extension of the shaft centerline). The position of the plane (and the marker) is defined by how high on the putter face the putter face-ball contact occurs. The position of the "sweet spot" marked on the putter is based upon—the spot (vertically) on the putter face where the ball-putter face contact is most likely to be made—being in line with the extension of the shalt centerline, as shown in FIG. 3.

No inordinate amount of twist is imparted to the putter shaft by the golfer's hands.

This design feature represents the second "0" in "0-0 EDGE."

d. Vertical Counterbalancing of the Golf Putter (or golf club)

Most golfers prefer a putter which has a certain feel when swung (that is the putter head feels neither too heavy nor too light). There can be a substantial difference in the weight of different putter heads, shafts, and grips. If shafts or grips are used which have sub-standard weights, the swing feel can be restored by counter-balancing the shaft. This can easily be done by inserting weights into the top of the shaft. This is the most efficient way of counterbalancing the putter as the least amount of weight is added. This method of counter balancing stems from the concept of rotational motion of the club is discussed in paragraph a (above). FIG. 2 illustrates how weights are inserted at, and into, the top of the shaft.

e. Shaft and Hosel In-Line

The "0-0 EDGE" putter has the shaft and hosel directly in line when viewed from behind the ball. The hosel is attached to the back of the putter blade. Therefore:

Because the hosel is attached to the back of the putter blade, which is about one-quarter inch thick, the golfer can see the back of the ball even though the hosel and shaft are in line (see FIG. 13).

Lining up the putt is easier than with other putters because the golfer tends to putt with his eyes in-line with the intended ball path and the putter marker (i.e., he feels like his eyes are in line with the ball path and the ball as they should be to prevent pulling or pushing). See FIG. 14.

The force transfer from the shaft—to the putter face—to the ball has a direct path (i.e., the force is not transmitted through "moment" carrying member(s)). Most putters employ an indirect path for this force as the putter shaft, the hosel, and the "sweet-spot" marker are not in line. (See FIG. 15.) This feature makes it easier to hit the ball the intended distance.

f. Conic-Shaped Sole

A conic-shaped sole is used to prevent scuffing of:

The putter head tail or toe. This is accomplished by rounding from tail to toe with a maximum radius of 10".

The putter head sole-frontal portion. This is accomplished by rounding or beveling the frontal portion of the sole. This prevents scuffing on the forward swing.

The putter head sole-rear portion. This is accomplished by rounding or beveling the rear portion of the sole. This prevents scuffing on the back swing.

Combining these three features result in the putter having a conic-shaped sole (i.e., the sole surface is not a plane but is a two-dimensional surface shaped like the surface of a circular cone) at the front and back if beveling is used or an oval-shaped sole (i.e., the sole surface is a portion of the surface of a hyperboloid of revolution) if rounding is use.

Figure 4:
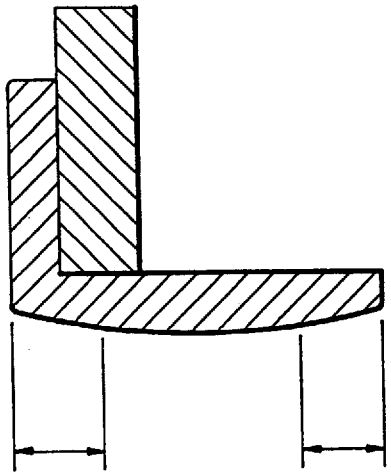

This design feature represents the "EDGE" in "0-0 EDGE" as shown in FIG. 4 (attached).

g. The "Heel-Heavy" model of our putter will be similar to the "0-0 EDGE" except the putter blade will not be in dynamic balance as the putter is swung back and forth. Instead, the putter tail will be heavier than is needed for dynamic balance (approximately 10% tail heavy as defined in FIG. 6) This putter is designed for those golfers who rotate the putter shaft counter-clockwise as they swing the putter towards the ball. Since most golfers actually decelerate the putter as it approaches the ball, the face of this putter tends to open as the putter face approaches the ball. This shaft rotational moment counteracts the counter clockwise rotation movement being applied to the putter by the golfer—and thus the face tends to stay square. The putter marker is in line with the putter shaft centerline and the ball centerline so that there is no force moment between the ball and the shaft when the ball is contacted. A net clockwise rotational moment is applied to the shaft at the moment of impact because the tail force-moment is greater than the toe force-moment. This clockwise rotational moment is balanced by the counter clockwise moment being applied by the golfer.

Figure 5:
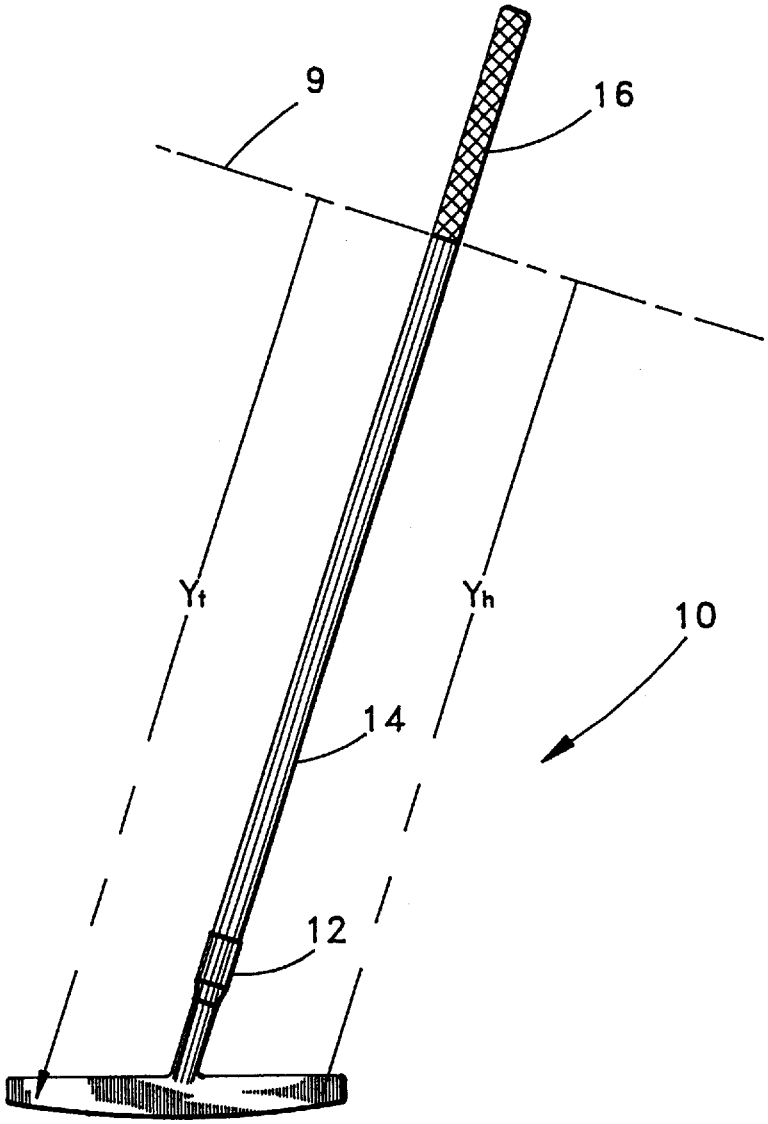
Figure 6:
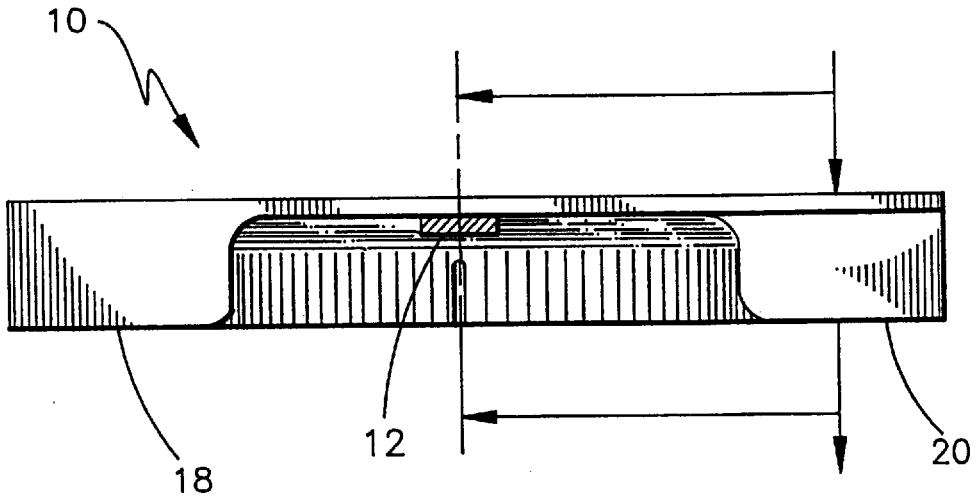
Figure 7:
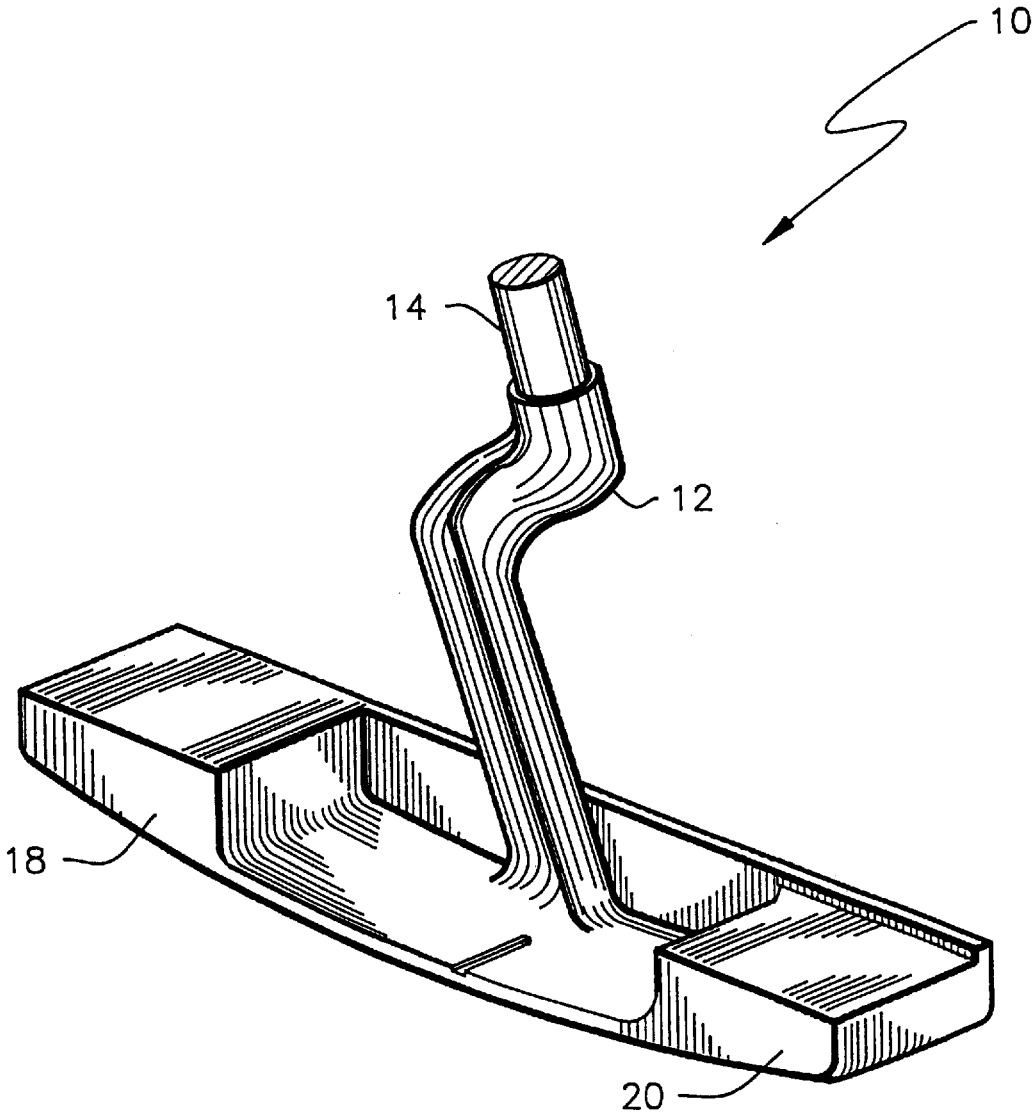
Figure 8:
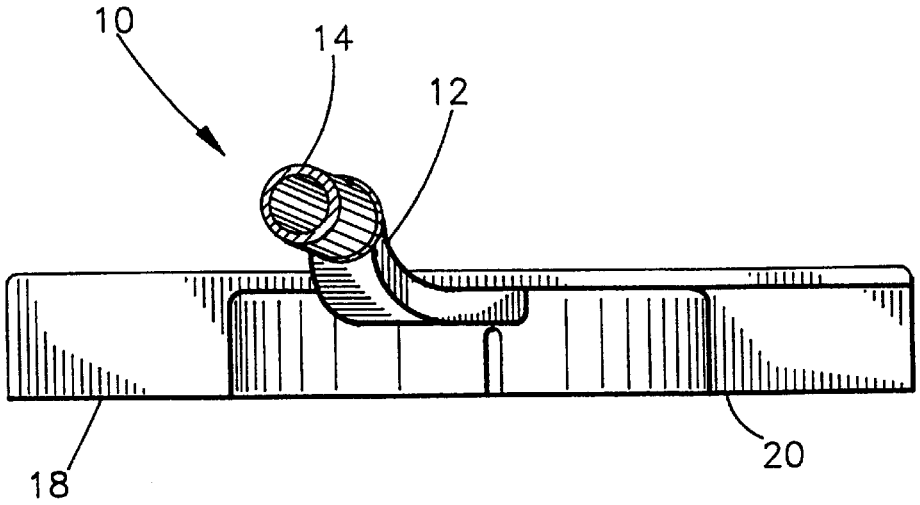
Figure 9:
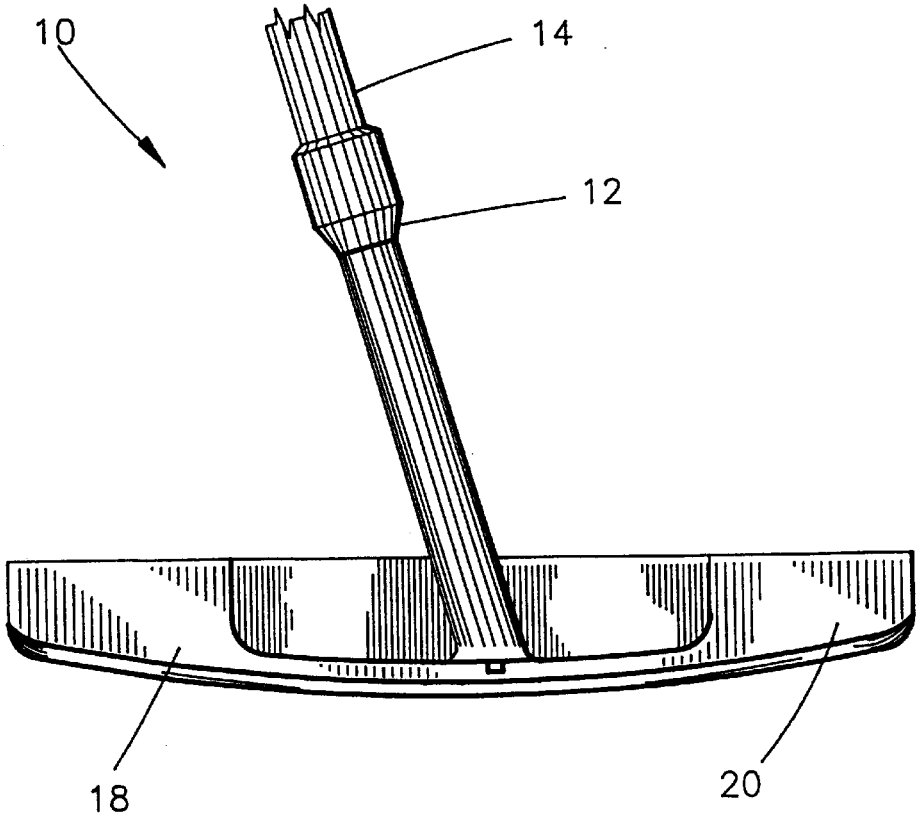
FIG. 9 is a rear view of the tail heavy golf putter head. This figure further illustrates the conic shaped back portion of the sole.
Figure 10:
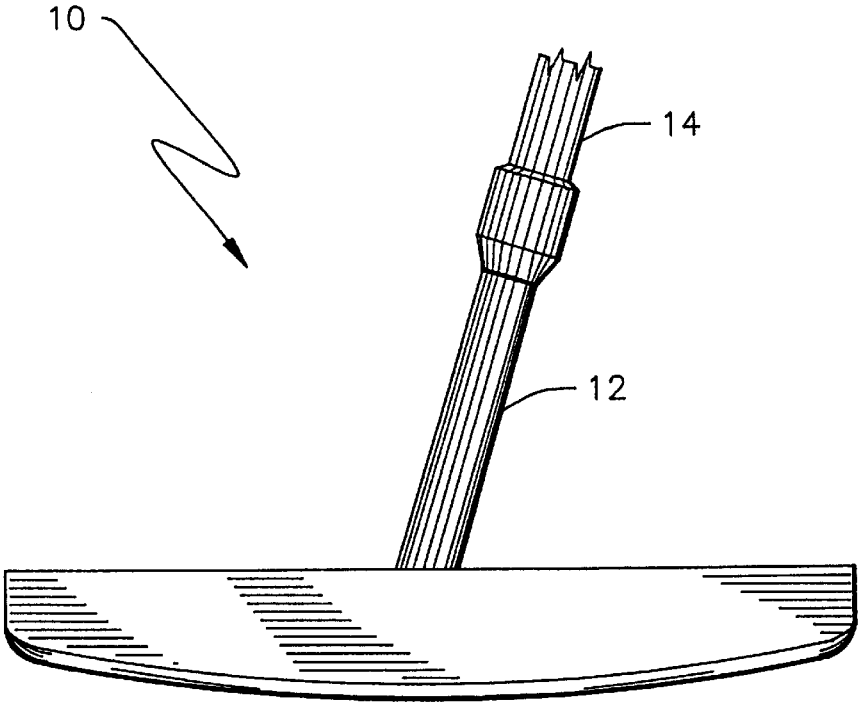
FIG. 10 is a front view of the tail heavy golf putter head. This figure shows the putter face, too and tail and the conic shaped front portion of the sole.
Figure 11:
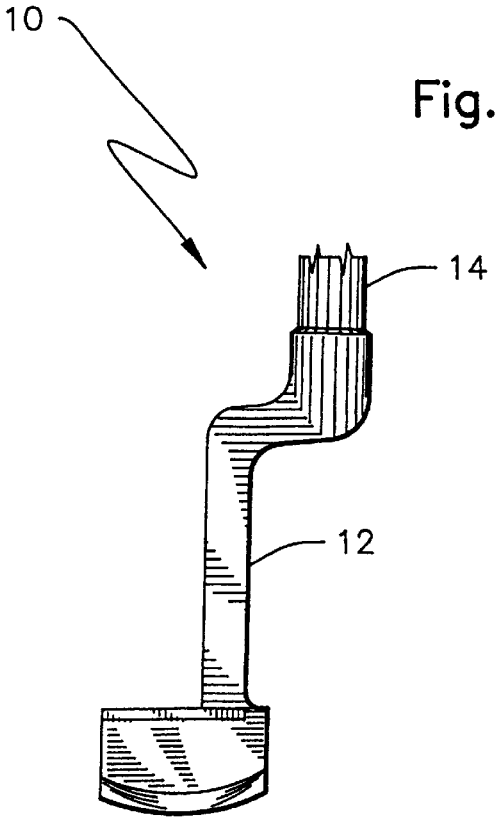
FIG. 11 is a toe side elevation of the tail heavy golf putter head. Also illustrated is the putter face and sole surface.
Figure 12:
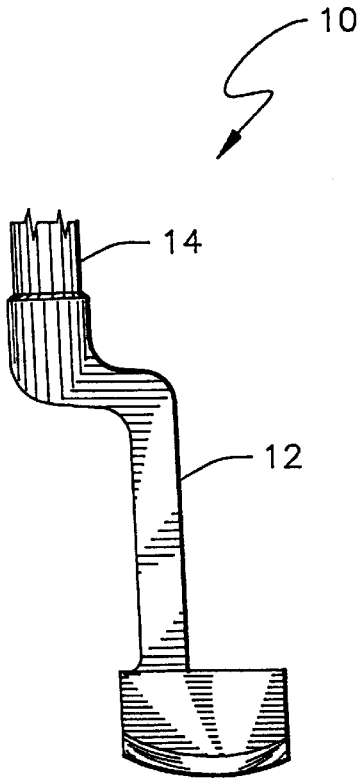
FIG. 12 is a tail side elevation of the tail heavy golf putter head. Also illustrated is the putter face and sole surface.

VI. Referring to FIGS. 5 and 6, applicants have shown an improved putter head 10 constructed according to the present invention which is operatively attached to a hosel 12. Hosel 12 is attached to an elongate shaft 14 with a grip 16 fitted over one of its ends.

Referring to FIG. 6, head 10 includes a tail section 18 and a toe section 20. Tail section 18 has a force moment associated therewith that is 0.1% to 15% greater than the force moment associated with toe section 20. Those skilled in the art know that force moment=mass×distance from the centerline of an axis. Thus, for example, to calculate the force moment of tail section 18, one multiplies the weight of section 18 by its distance from the axis defined by shaft 14.

VII. The symmetric blade golf putter of FIGS. 16, 17, 18 and 19 is an alternative embodiment, to the cavity back putter disclosed in the parent application, wherein a symmetric blade 30 constructed according to the present invention is operatively attached to a hosel 12. Hosel 12 is attached to an elongate shaft 14 with a grip 16 fitted over one of its ends(Reference to FIG. 5). Said elongate shaft 14 defining a shaft axis 24. By reference to FIG. 5 an instantaneous swing axis 9 perpendicular to the shaft axis 24 and to the swing plane.

Figure 16:
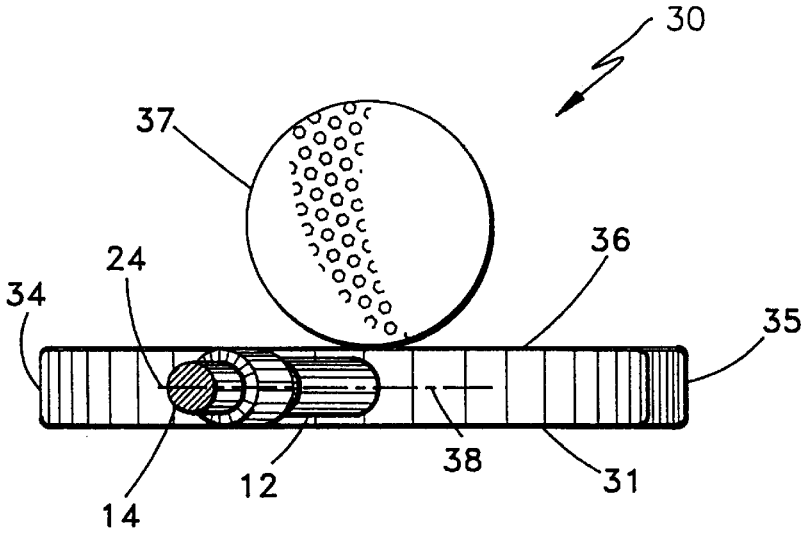
FIG. 16 is a plan view of the symmetric blade utter head looking down the putter shaft at the putter head.
Figure 17:
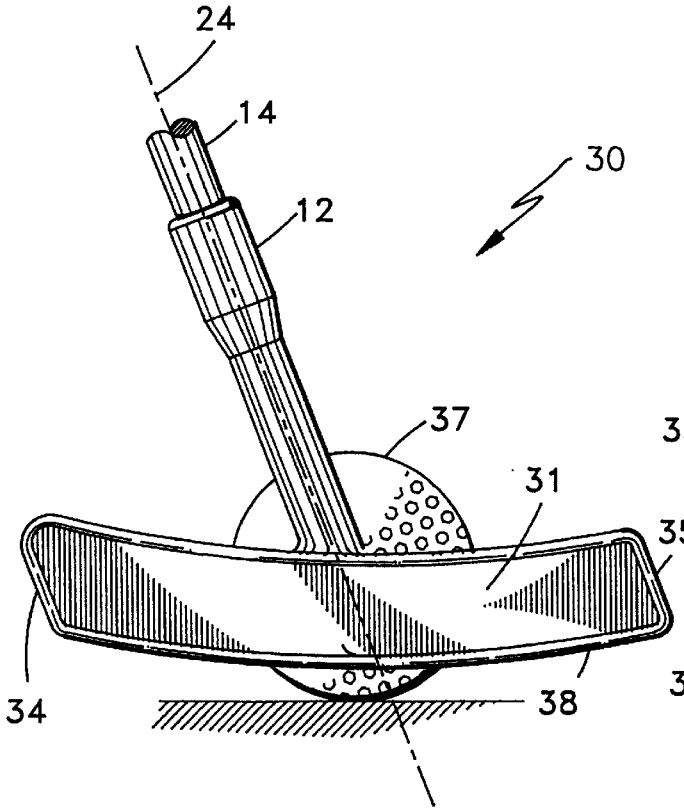
FIG. 17 is a side view of the symmetric blade putter head.
Figure 18:
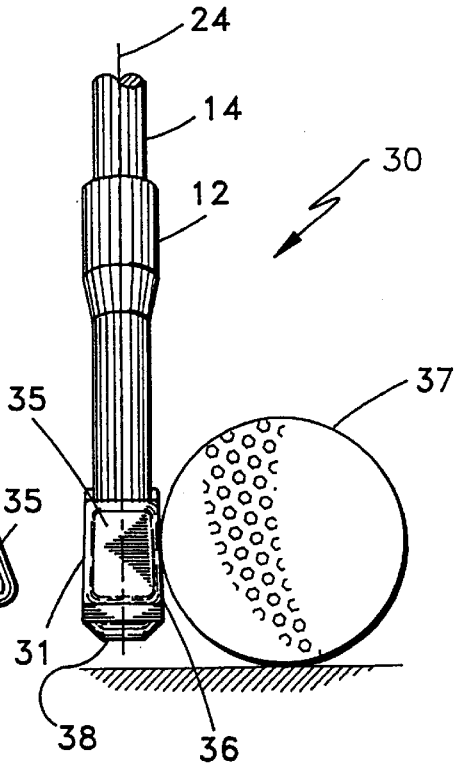
FIG. 18 is a profile view of the symmetric blade putter head in contact With a golf ball.
Figure 19:
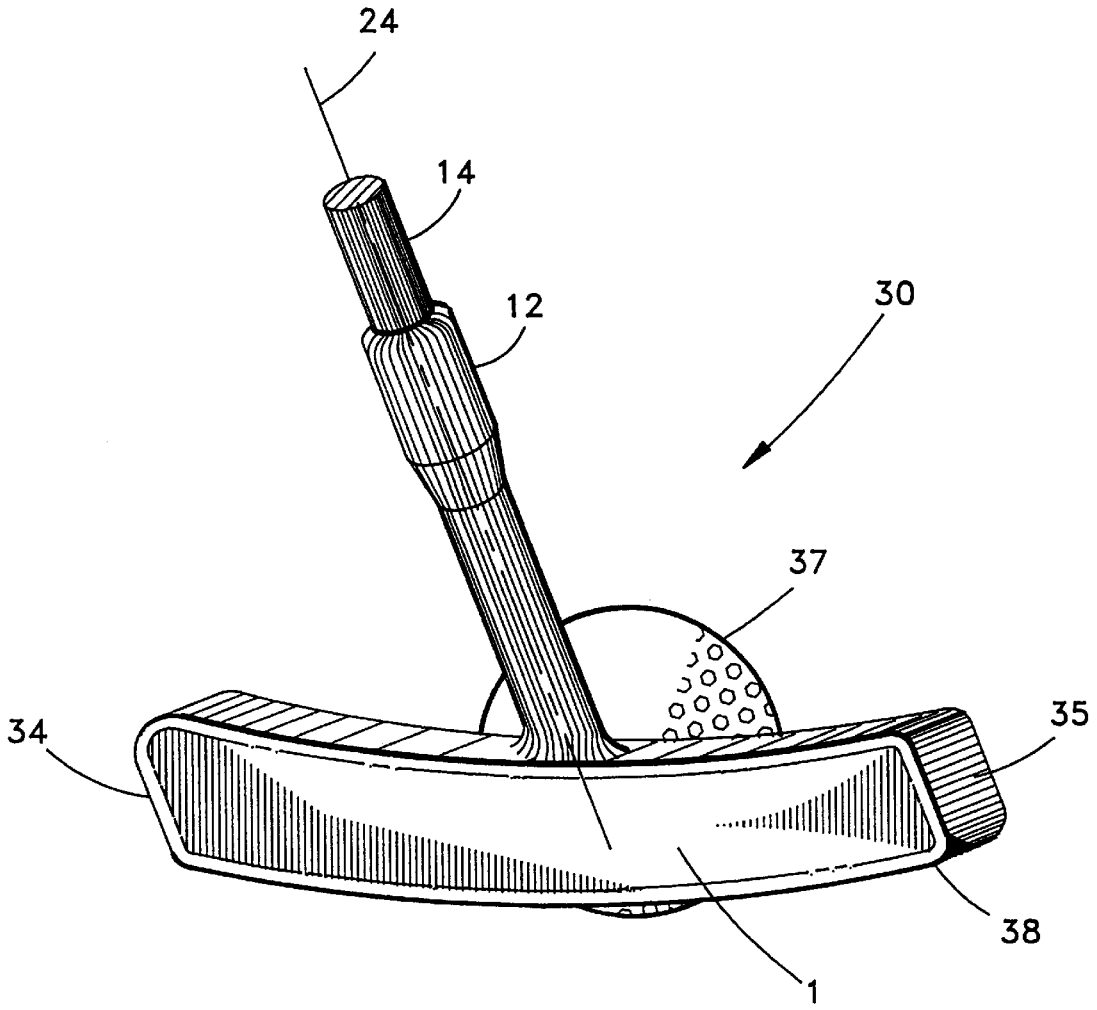
FIG. 19 illustrates a perspective view of the symmetric blade with golf ball.
Figure 20:
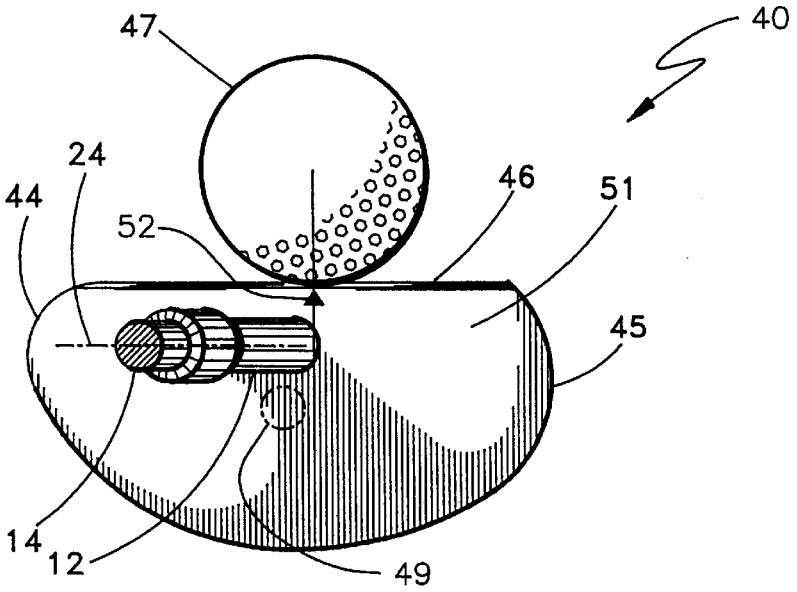
FIG. 20 is a plan view of the mallet head putter head.
Figure 21:
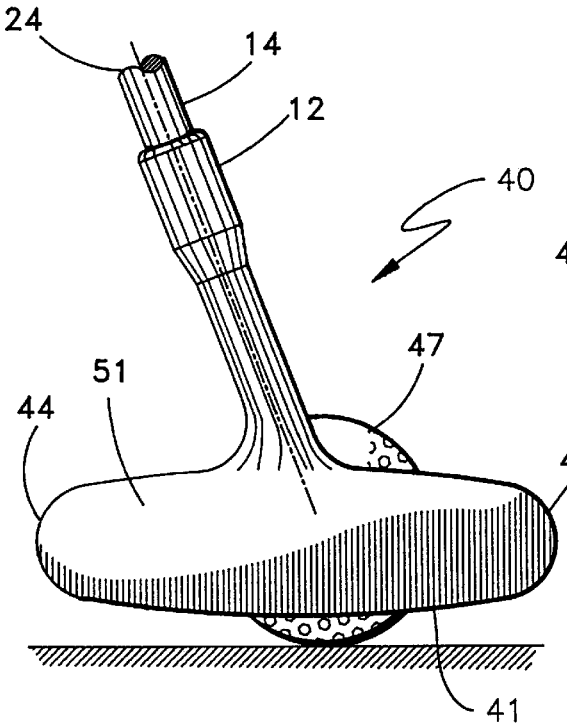
FIG. 21 is a rear view of the mallet head putter head.
Figure 22:
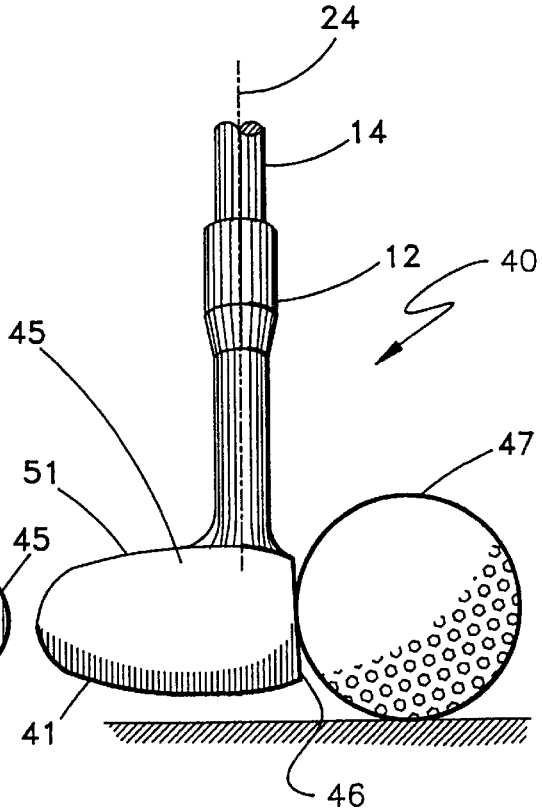
FIG. 22 illustrates a profile of a mallet head putter in contact with a golf ball.
Figure 23:
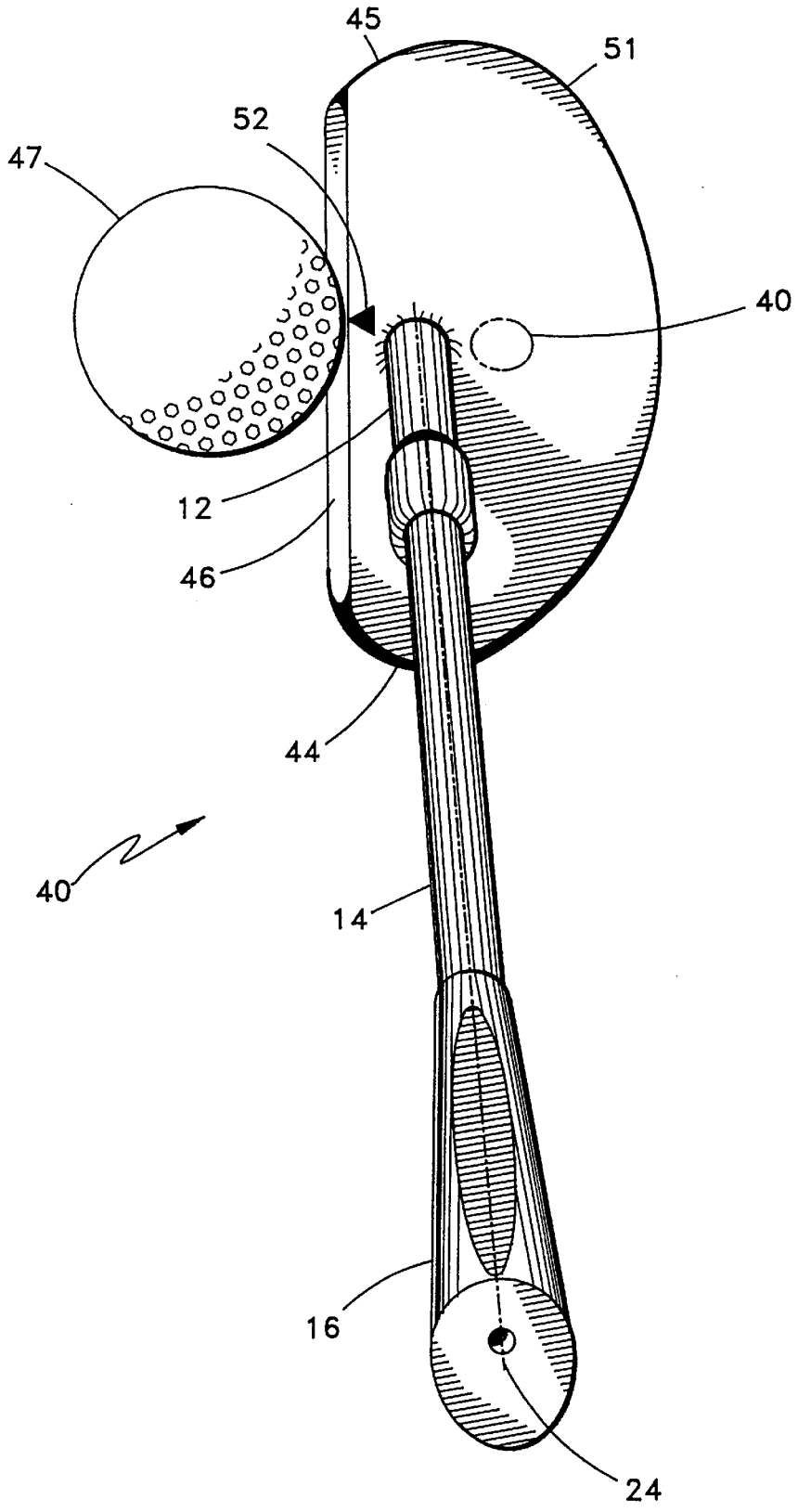
FIG. 23 illustrates a perspective view of the mallet head with golf ball.
Figure 24:
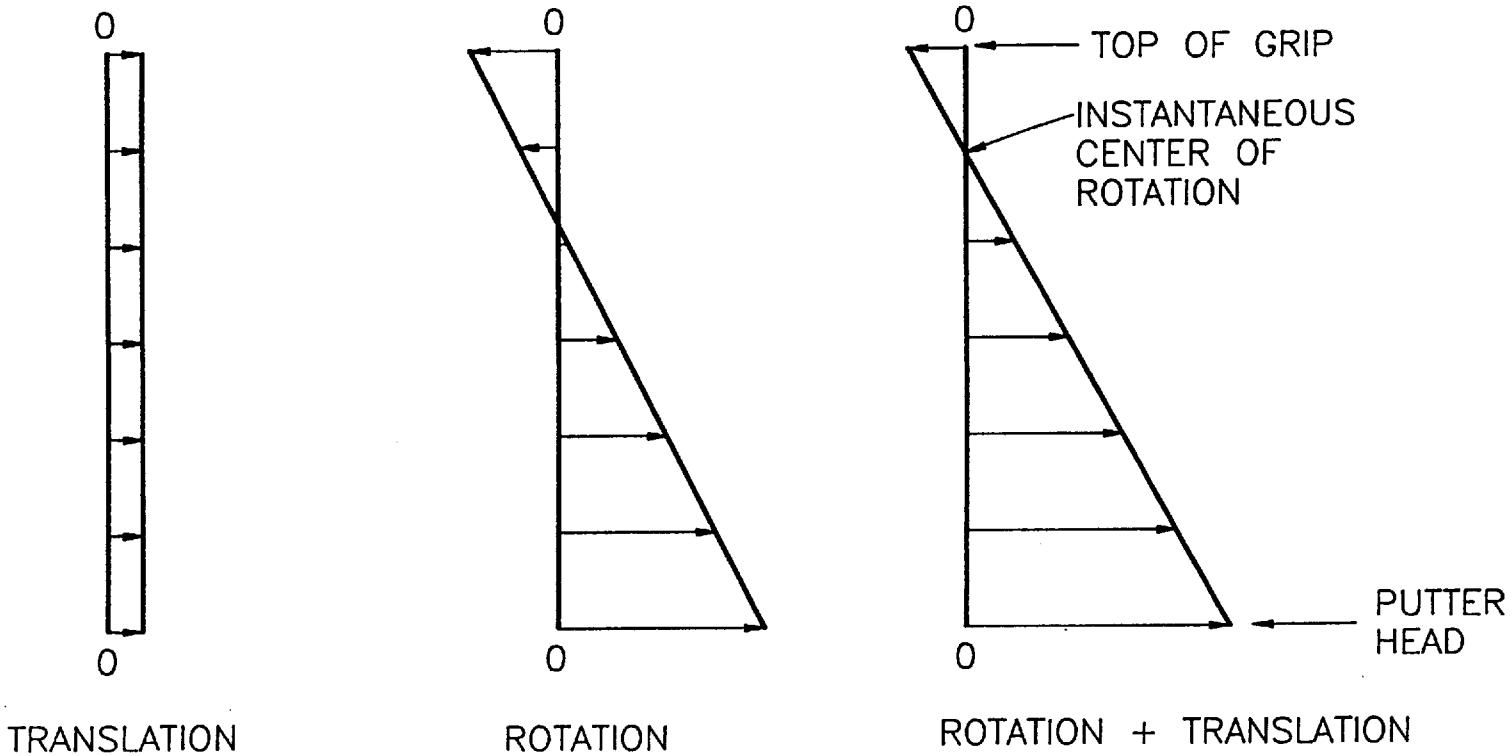
FIG. 24 illustrates a diagram representing the issues of rotation and translation discussed in the Summary of the Invention.

Referring to FIG. 16, head 30 includes a tail section 34 and a toe section 35 and a flat semi-vertical right and left face 31, 36. Tail section 34 has a force moment associated therewith that is 0.1% to 15% greater than the force moment associated with toe section 35. Those skilled in the art know that force moment=mass×distance from the centerline of an axis. Thus, for example, to calculate the force moment of tail section 34, one multiplies the weight of section 34 by the distance of the center of gravity of section 34 from the axis defined by shaft 14.

The mallet head putter of FIGS. 20, 21, 22 and 23 illustrate and is an alternative embodiment, to the cavity back putter disclosed in the parent application, wherein a mallet head putter 40 constructed according to the present invention which is operatively attached to a hosel 12 at a putter head top surface 51. Hosel 12 is attached to an elongate shaft 14 with a grip 16 fitted over one of its ends(reference to FIG. 5). Said elongate shaft 14 defining a shaft axis 24. By reference to FIG. 5 an instantaneous swing axis 9 perpendicular to the shaft axis 24 and to the swing plane.

Referring to FIGS. 20, 21, 22 and 23, mallet head 40 includes a tail section 44 and a toe section 45. Tail section 44 has a force moment associated therewith that is 0.1% to 15% greater than the force moment associated with toe section 45. Those skilled in the art know that force moment=mass×distance from the centerline of an axis. Thus, for example, to calculate the force moment of tail section 44, one multiplies the weight of section 44 by its distance of the center of gravity of section 44 from the axis defined by shaft 14.

While a preferred embodiment of the present invention has been shown and described, it will be apparent to those skilled in the art that many changes may be made without departing from the invention in its broader aspects. The appended claims are therefore intended to cover all such changes and modifications as fall within the true spirit and scope of the invention.

I claim:

1. A golf putter comprising:

A. an elongate shaft (14) including a longitudinal center line defining a shaft axis (24), a putter head rigidly connected to one end of the shaft (14) by means of a hosel (12), hand grip means (16) at the other end of the shaft (14); a putter head toe section and a tail section longitudinally spaced from said shaft axis (24); said putter head having at least one semi-vertical flat face; said shaft (14) being upwardly inclined toward the tail section to define an instantaneous swing axis (9) perpendicular to the longitudinal shaft axis (24) thereby spacing the swing axis a greater distance from the toe section than the distance between the swing axis and the tail section for moving the toe section at a velocity greater than the tail section during translational and rotational motion of the putter as it strikes a golf ball;

B. the golf putter head includes a bottom surface defining a sole extending smoothly between the toe end of the putter head and the tail end of the putter head, said sole being curved longitudinally and transversely; the shaft (14) connected to the golf putter head wherein the static force moment of the tail section is 0.1% to 15% greater than the static force moment of the toe section relative to the shaft axis (24), said shaft axis (24) being located substantially equally spaced from said toe section and tail section.

2. The golf putter of claim 1 further comprising:

said putter head is a symmetric blade (30) which is symmetric in the transverse direction so that it can be used by a right handed or left handed golfer; said symmetric blade (30) has a flat semi-vertical left face (31) and flat semi-vertical right face (36) said shaft (14) having a lower end that is rigidly connected to the symmetric blade (30) putter head, so that the symmetric blade (30) left and right faces (31, 36) are symmetric about the shaft axis (24).

3. A golf putter comprising:

A. an elongate shaft including a longitudinal center line defining a shaft axis, putter head rigidly connected to one end of the shaft by means of a hosel, hand grip means at the other end of the shaft; a putter head toe section and a tail section longitudinally spaced from said shaft axis; said putter head having at least one semi-vertical flat face; said shaft being upwardly inclined toward the tail section to define an instantaneous swing axis perpendicular to the longitudinal shaft axis thereby spacing the swing axis a greater distance from the toe section than the distance between the swing axis and the tail section for moving the toe section at a velocity greater than the tail section during translational and rotational motion of the putter as it strikes a golf ball;

B. the golf putter head includes a bottom surface defining a sole extending smoothly between the toe end of the putter head and the tail end of the putter head, said sole being curved longitudinally and transversely; the shaft connected to the golf putter head wherein the static force moment of the tail section is 0.1% to 15% greater than the static force moment of the toe section relative to the shaft axis, said shaft axis being located substantially equally spaced from said toe section and tail section;

C. said putter head is a mallet head putter head shaped approximately in a half-circle in plan view with the straight portion of the half-circle locating a flat semi-vertical face, a mallet head putter head bottom surface defining the sole; a putter head top surface; said shaft having a lower end that is rigidly connected to the mallet head putter head top surface; the toe and tail sections approximately equal in size; said shaft connected to the mallet head putter head approximately along a division line between the toe and tail sections; said putter semi-vertical face and mallet head approximately bisected by the swing plane through the shaft axis.

* * * * *